United States Patent [19]

Rushton

[11] Patent Number: 4,879,094

[45] Date of Patent: Nov. 7, 1989

[54] CU—SN—ZN—BI ALLOYS

[75] Inventor: William Rushton, Wakefield, England

[73] Assignee: IMI Yorkshire Fittings Limited, Leeds, England

[21] Appl. No.: 258,724

[22] Filed: Oct. 17, 1988

[30] Foreign Application Priority Data

Oct. 16, 1987 [GB] United Kingdom ..... 8724311

[51] Int. Cl.[4] ..... C22C 9/02; C22C 9/04

[52] U.S. Cl. ..... 420/476; 420/475

[58] Field of Search ..... 420/475, 476

[56] References Cited

FOREIGN PATENT DOCUMENTS

| | | |
|---|---|---|
| 54-135618 | 10/1979 | Japan . |
| 57-073149 | 5/1982 | Japan . |
| 57-073150 | 5/1982 | Japan . |
| 59-050143 | 3/1984 | Japan . |
| 61-133357 | 6/1986 | Japan . |
| 14910144 | 7/1939 | United Kingdom . |
| 509657 | 4/1940 | United Kingdom . |
| 519597 | 9/1977 | United Kingdom . |

OTHER PUBLICATIONS

Nekhendzi et al., "Pressure Tightness of Casting Alloys", Liteinye Svoistva Splavov, Tr. Soveshch, 1st, 191–204, (1968).
Abstract: CA91(12):95313v.
Abstract: CA100(17):138151g.
Abstract: CA86(22):159499s.
Abstract: CA104(18):16371r.
Abstract: CA106(6):37211c.
Nam et al., "A Study on the Structure and Mechanical Properties of Graphite Dispersed Tin Bronze Castings", Tachan Kumsok Hakhoe Chi, 18(6):563–571, (1980).
Hess, *Trans. Am. Foundrymans Soc.,* 69:601–609, (1961).
Lainer et al., *USSR,* 138, 747, Applied, Nov. 6th, 1960.

*Primary Examiner*—Upendra Roy
*Assistant Examiner*—David W. Schumaker
*Attorney, Agent, or Firm*—Cushman, Darby & Cushman

[57] ABSTRACT

An alloy for the manufacture of cast components, for example taps, water meters, pipe couplings and parts thereof, intended for use in potable water supply installations comprises 1.5 to 7 wt % bismuth, from 5 to 15 wt % zinc, from 1 to 12 wt % tin, the balance apart from any impurities and any minor amounts of elemental additives being copper.

12 Claims, No Drawings

CU—SN—ZN—BI ALLOYS

BACKGROUND OF THE INVENTION

This invention relates to casting alloys, particularly but not exclusively to alloys for use in the production of components suitable for supply systems carrying water for human consumption (hereinafter referred to as "potable" water).

THE PRIOR ART

Hitherto, it has been usual to produce such components, for example taps, valves, meters and pipe couplings, from copper-based casting alloys such as gun metals. Because it is necessary to machine the alloy casting to form the final product, it is necessary to use a free-machining alloy. Conventionally, gun metals and other copper-based casting alloys are rendered free-machining by the addition of quantities of lead, typically from about 1–9%, usually about 5%, by weight. However, there has been general concern over the last few years about the harmful cumulative effect of lead in drinking water. Certain plumbo-solvent waters readily leach lead out of such alloys. An additional hazard arises because the atmosphere of foundries in which such alloys are made and processed inevitably contains lead. Also, foundry waste such as used sand contains lead and so presents disposal problems.

Efforts have, therefore, been made during recent years to develop substantially lead-free alloy components for use in potable water, and other, applications but to date we are not aware that a commercially and technically suitable substitute alloy has been found. In this connection, and particularly in the context of components for potable water supply systems, any such substitute alloy should preferably be comparable cost-wise to the conventional lead-containing alloys and of course must possess acceptable processing, mechanical and corrosion-resistant properties. In particular, they should be castable into sound, pressure tight castings that are readily machinable into finished components having, inter alia, acceptable strength and leak-tightness properties. Further, in cases where the alloy contains zinc, they should be capable of being rendered de-zincification resistant or should be inherently immune to de-zincification.

SUMMARY OF THE INVENTION

We have now surprisingly discovered that a substantially lead-free, free-machining and de-zincification-immune casting alloy that is suitable for use in, for example, the production of components for use in the supply of potable water and that has no known significant pollution problems associated with it may be produced by incorporating bismuth, largely or wholly instead of lead, into certain copper alloys.

According to one aspect of the present invention, therefore, there is provided an alloy containing from 1.5 to 7 wt % bismuth, from 5 to 15 wt % zinc, from 1 to 12 wt % tin, the balance apart from any impurities and any minor amounts of elemental additives being copper.

The bismuth content is preferably from 1.5 to 5 wt %, more preferably from 2 to 5 wt % and advantageously from 2 to 3 wt %, the zinc content is preferably from 5 to 12 wt %, more preferably from 5 to 10 wt % and advantageously from 6 to 8 wt %, and the tin content is preferably from 2.5 to 5 wt %. A particularly preferred alloy of the invention comprises from 2 to 3 wt % bismuth, from 5 to 8 wt % zinc and from 2.5 to 5 wt % tin, especially from 2 to 2.2 wt % bismuth, from 7.1 to 7.8 wt % zinc and from 3.3 to 3.6 wt % tin.

The alloy may contain small amounts of impurities and/or elemental additives, especially those commonly present in copper-based casting alloys, provided that their presence does not significantly adversely affect the required properties of the alloy and that, where the alloy is to be used for potable water components, they will not, if toxic, be leached in significant quantities out of the alloy by potable water. In this connection, bismuth is believed to be essentially non-toxic to the extent that it might be leached out of alloys of the invention by potable water. The total amount of impurities should preferably not exceed about 1% by weight and generally any deliberate additions will not exceed about 3, preferably 2, % by weight. Examples of permitted impurities and/or additives and of their preferred maxima, are as follows:

Nickel - from 0 to 2 wt % inclusive
Lead - from 0 to 0.4 wt % inclusive
Iron/Antimony/Arsenic - from 0 to 0.75 wt % inclusive in total
Aluminium - from 0 to 0.01 wt % inclusive
Silicon - from 0 to 0.02 wt % inclusive
Sulphur - from 0 to 0.01 wt % inclusive
Manganese - from 0 to 0.5 wt % inclusive Of the above, nickel and/or iron and/or manganese, for example, may be deliberately added in order to modify slightly the properties of the alloys, but alternatively may be present as impurities.

It will be noted that the alloys may contain small amounts of lead (usually but not necessarily as an incidental impurity), but that such amounts will be very much smaller than the amounts thereof that have hitherto been added to copper alloys in order to improve their machinability.

According to a further aspect of the present invention there is provided a component for use in potable water installations, for example a tap, valve, meter or pipe coupling, comprising an alloy of the invention.

Principally, the main body of such a tap etc will be made of the alloy, although we include within the expression "component" any metallic part and especially parts exposed in use to potable water such as, for example, internal metallic parts of taps, valves, water meters etc.

Alloys in accordance with the invention may be manufactured and processed by conventional means. In particular they may be cast and are readily machinable.

In addition, they have, in general, properties that render them especially suitable for use in the manufacture of components suitable for use with potable water such as stop cocks, taps, water meters, gate valves, check valves and pipe couplings of the capillary solder or mechanical (eg compression, flanged or screw-threaded) type. Amongst the more important properties of such components are the following:

Pressure tightness (an indication of, inter alia, low porosity)
Tensile properties
Fatigue properties
Impact properties
Corrosion resistance (including immunity to de-zincification)
Ageing properties Solderability (especially in the case of the capillary solder type couplings)

Indeed the above properties of alloys of the invention are substantially equal to the corresponding properties of the commonly used leaded gun-metals having the nominal compositions tin 3 wt %, lead 5 wt %, zinc 8 wt %, balance copper (hereinafter referred to as "LGI" of BS1400 (1985) Table 5) and tin 5 wt %, lead 5 wt % and zinc 5 wt %, balance copper (hereinafter referred to as "LG2" of BS1400 (1985) Table 5), respectively.

As regards corrosion resistance, in particular, alloys of the invention have been found to be inherently immune to de-zincification.

DESCRIPTION OF THE PREFERRED EMBODIMENT

The following Examples illustrate the invention.

EXAMPLES 1 TO 5

A series of alloys having the nominal compositions given in Table I below were made by melting together the constituents listed. In order to avoid gas-off of the zinc constituent, the zinc was added in the form of brass.

TABLE I

| Example No | Zn wt % | Sn wt % | Bi wt % | Balance |
|---|---|---|---|---|
| 1 | 5.5 | 4 | 3 | Cu apart from incidental impurities |
| 2 | 10.0 | 4 | 3 | |
| 3 | 5.5 | 4 | 2 | |
| 4 | 10.0 | 4 | 2 | |
| 5 | 7.5 | 3.5 | 2.1 | |

The alloys were then cast into a number of samples for the purposes of determining volume % porosity and tensile and impact properties.

Table II, III, IV and V below give the mean values of the results obtained, together with corresponding comparative data for the alloys LG1 and/or LG2.

The porosity measurements were determined with a Quantimet Image Analyser using polished and unetched specimens.

The tensile tests were carried out on samples of two sizes, namely rods having diameters of 6.04 mm and 7.98 mm respectively, and at different temperatures.

The impact tests were carried out, at different temperatures, using an Izod machine, on machined and notched samples.

TABLE II

| Porosity Tests | |
|---|---|
| Example No. | Porosity (Volume %) |
| 1 | 0.2 |
| 2 | 3.4 |
| 3 | 0.25 |
| 4 | 5.1 |
| 5 | 1.2 |
| LG1 | 1.6 |
| LG2 | 1.1 |

TABLE III

| Tensile Tests on Smaller Diameter Samples | | | |
|---|---|---|---|
| Example No | Temp °C. | Elongation at Break % | UTS* N/mm² |
| 1 | 20 | 23 | 231 |
| | 100 | 23 | 211 |
| | 150 | 14 | 188 |
| 2 | 20 | 13 | 145 |
| | 100 | 13 | 137 |

TABLE III-continued

| Tensile Tests on Smaller Diameter Samples | | | |
|---|---|---|---|
| Example No | Temp °C. | Elongation at Break % | UTS* N/mm² |
| | 150 | 9 | 114 |
| 3 | 20 | 25 | 232 |
| | 100 | 23 | 214 |
| | 150 | 24 | 213 |
| 4 | 20 | 23 | 220 |
| | 100 | 16 | 168 |
| | 150 | 11 | 151 |
| 5 | NOT CARRIED OUT | | |
| LG1 | 20 | 13 | 201 |
| | 100 | 13 | 194 |
| | 150 | 5 | 131 |
| LG2 | 20 | 8 | 186 |
| | 100 | 11 | 175 |
| | 150 | — | — |

*UTS means Ultimate Tensile Strength

TABLE IV

| Tensile Tests on Larger Diameter Samples | | | |
|---|---|---|---|
| Example No | Temp °C. | Elongation at Break % | UTS* N/mm² |
| 1 | 20 | 15 | 202 |
| | 100 | 14 | 180 |
| | 150 | 21 | 205 |
| 2 | 20 | 7 | 130 |
| | 100 | 9 | 124 |
| | 150 | 9 | 124 |
| 3 | 20 | 7 | 119 |
| | 100 | 10 | 140 |
| | 150 | 9 | 130 |
| 4 | 20 | 11 | 141 |
| | 100 | 9 | 134 |
| | 150 | 10 | 132 |
| 5 | 20 | 5 | 132 |
| | 100 | 3 | 96 |
| | 150 | 2 | 67 |
| LG1 | 20 | 8 | 163 |
| | 100 | 8 | 155 |
| | 150 | 8 | 162 |
| LG2 | 20 | NOT CARRIED OUT | |
| | 100 | | |
| | 150 | | |

TABLE V

| Impact Tests | | |
|---|---|---|
| Example No | Temp °C. | Impact Energy - Joules |
| 1 | 20 | 26 |
| | 100 | 25 |
| | 150 | 27 |
| 2 | 20 | 23 |
| | 100 | 25 |
| | 150 | 26 |
| 3 | 20 | 23 |
| | 100 | 25 |
| | 150 | 31 |
| 4 | 20 | 26 |
| | 100 | 21 |
| | 150 | 29 |
| 5 | 20 | 23 |
| | 100 | 21 |
| | 150 | 18 |
| LG1 | 20 | 19 |
| | 100 | 21 |
| | 150 | 24 |
| LG2 | 100 | NOT CARRIED OUT |

In view of the known difficulties with mechanical testing of small cast sections and the generally accepted wide spread of results from such tests, the above results indicate that each of the alloys of Examples 1 to 5 compare favourably with the known lead-containing gun metals designated LG1 and, where determined, LG2.

In addition, the machinability of each of them is comparable to that of LG1 and LG2, each achieving a rating of "Excellent" in accordance with BS 1400 (1985).

Further their solderability with tin/lead or tin/copper soft solders or tin/silver brazing alloys, i.e. those commonly used in the plumbing trade, is quite acceptable and again comparable with the solderability of LG1 and LG2.

Finally, each was found to be inherently immune to de-zincification as defined in BS 2872.

In addition, each of the alloys of Examples 1 to 4 and LG2 were subjected to like tensile tests at elevated temperatures between 150° C. and 350° C. The results are given in Table VI.

TABLE VI

| Tensile Tests at Elevated Temperature | | | |
|---|---|---|---|
| Example No | Temp °C. | Elongation % at Break | UTS N/mm² |
| 1 | 250 | 16 | 177 |
| | 300 | 4 | 121 |
| | 340 | 2 | 100 |
| 2 | 250 | 2 | 85 |
| | 300 | 4 | 79 |
| 3 | 200 | 5 | 140 |
| | 250 | 2 | 107 |
| | 300 | 2 | 86 |
| 4 | 250 | 9 | 153 |
| | 300 | 2 | 92 |
| LG2 | 250 | 4 | 156 |
| | 300 | 6 | 155 |

These results indicate that alloys of the invention have, at elevated temperatures, tensile properties that compare well with LG2. In potable water applications, the elevated temperature tensile properties are not, of course, relevant to components in service because the maximum temperature likely to be reached in practice is around 20° C., although such components may equally be used in hot water service applications; even here, however, the maximum working temperature is unlikely to exceed about 70° C.

However, the elevated temperature tensile properties of certain alloys of the invention indicate hot-shortness, that is to say a tendency to become less ductile at temperatures above their normal working range. This is relevant to processing and, in particular, means that in certain cases it is desirable to allow the castings to cool at a relatively slow rate in order to prevent the formation of flaws in the cast components.

EXAMPLE 6

An alloy having the following composition (accurate to ±1% of the amounts stated):

| | |
|---|---|
| Copper | 86.00 wt % |
| Zinc | 7.70 wt % |
| Tin | 3.35 wt % |
| Bismuth | 2.08 wt % |
| Lead (as impurity) | 0.35 wt % |
| Other Impurities | 0.52 wt % |
| TOTAL | 100% |

was melted in a batch weighing about 165.5 kg and was cast by shell-moulding and machined into 1358 15 mm×½" BSP backplate elbow fittings (IMI Yorkshire Fittings Ltd's "No 15" fittings). Such a fitting comprises a ½" BSP female threaded portion, a 15 mm capillary socket an an integral backplate for mounting the fitting on, for example, a wall. Several of the fittings were routinely installed for test purposes and the fitting bodies, the threaded joints and the capillary solder joints were all leak-tight at a test water pressure of 5 bar. In addition, each fitting (and particularly the junction between the main body and the backplate) had quite acceptable strength.

A further batch of 24.5 kg of the above alloy was cast by shell moulding and machined into 35 54 mm×2" BSP male elbow pipe connectors (IMI Yorkshire Fittings Ltd's "No 13" fittings). Such a connector comprises a 54 mm capillary socket and a 2" BSP male threaded portion. The fittings were routinely installed for test purposes and the bodies and joints were found to be leak-tight at a test water pressure of 5 bar.

EXAMPLE 7

An alloy having the following composition (accurate to ±1% of the amounts stated):

| | |
|---|---|
| Copper | 86.00 wt % |
| Zinc | 7.25 wt % |
| Tin | 3.55 wt % |
| Bismuth | 2.15 wt % |
| Lead (as impurity) | 0.34 wt % |
| Other Impurities | 0.71 wt % |
| TOTAL | 100% |

was melted in similar batch sizes to the alloy of Example 7 and the same fittings were cast by shell moulding and machined from it. Similarly good leak-tightness (at a water pressure of 5 bar) and strength results were obtained.

Preferably the casting alloys of the invention have a copper+zinc+tin content of at least 90 wt % and more preferably at least 95 wt %, ie. a minimum copper content preferably of 63 wt %, more preferably of 68 wt %. Advantageously, the copper+zinc+tin content is from about 95.7 to 97.5 wt % of which the copper content advantageously lies between 80 and 90 wt %.

Casting alloys within the scope of the present invention, substantially to the exclusion of alloys containing primarily copper, zinc, tin and bismuth outside that scope, all have properties which render them suitable for use in the manufacture, by casting (especially using sand or shell moulds) and, if desired, subsequent machining, of, in particular, components for use in potable water installations. Substantially any deviation from the broadest constituent ranges specified results in a marked deterioration in one or more of the properties hereinbefore mentioned. Thus, with a bismuth content of less than 1.5 wt %, the chip formation during machining results in long stringers which are difficult to clear from auto machine tools (in other words, alloys with less than 1.5 wt % bismuth would not rate as "Excellent" as defined in BS1400). With a bismuth content over 7 wt %, hot shortness during casting becomes a problem and also the power consumption during machining increases which is indicative of higher tool loads and toolwear, ie. again a detraction from the "Excellent" machining rating of BS1400 occurs.

A minimum of 5 wt % zinc is necessary to limit the grain boundary effects of the bismuth constituent which effects detract significantly from the resulting mechanical properties of the castings. The presence of more than 15 wt % zinc gives rise to unacceptable porosity levels and a marked increase in susceptibility to dezincification.

A minimum of 1 wt % tin is required to afford an acceptable level of corrosion resistance especially in a potable water context and to afford sufficient fluidity to the alloy during the casting process. However, with over 12 wt % tin, intermetallic phases are likely to be formed which have adverse effects on the mechanical properties of the alloy.

What is claimed is:

1. A substantially lead free alloy containing from 1.5 to 7 wt % bismuth, from 5 to 15 wt % zinc, from 1 to 12 wt % tin, the balance being essentially copper.

2. An alloy according to claim 1 containing from 1.5 to 5 wt % bismuth.

3. An alloy according to claim 2 containing from 2 to 3 wt % bismuth.

4. An alloy according to claim 1 containing from 5 to 12 wt % zinc.

5. An alloy according to claim 4 containing from 6 to 8 wt % zinc.

6. An alloy according to claim 1 containing from 2.5 to 5 wt % tin.

7. An alloy according to claim 1 comprising from 2 to 2.2 wt % bismuth, from 7.1 to 7.8 wt % zinc and from 3.3 to 3.6 wt % tin.

8. An alloy according to claim 1 including impurities not exceeding about 1% by weight.

9. An alloy according to claim 1 wherein any lead content does not exceed about 0.4 wt %.

10. An alloy according to claim 1 including additives not exceeding about 3% by weight.

11. An alloy according to claim 10 including up to 2 wt % nickel.

12. A component for use in a water supply installation comprising a substantially lead free alloy containing from 1.5 to 7 wt % bismuth, from 5 to 15 wt % zinc, from 1 to 12 wt % tin, the balance being essentially copper.

* * * * *